US011015771B2

(12) United States Patent
Wu et al.

(10) Patent No.: US 11,015,771 B2
(45) Date of Patent: May 25, 2021

(54) LED PLANT ILLUMINATION LAMP MODULE

(71) Applicant: FUJIAN SANAN SINO-SCIENCE PHOTOBIOTECH CO., LTD., Quanzhou (CN)

(72) Inventors: Chanjuan Wu, Quanzhou (CN); Liang Zeng, Quanzhou (CN); Shaoqing Lin, Quanzhou (CN); Nana Li, Quanzhou (CN)

(73) Assignee: FUJIAN SANAN SINO-SCIENCE PHOTOBIOTECH CO., LTD., Quanzhou (CN)

( * ) Notice: Subject to any disclaimer, the term of this patent is extended or adjusted under 35 U.S.C. 154(b) by 26 days.

(21) Appl. No.: 16/349,989

(22) PCT Filed: Jan. 9, 2019

(86) PCT No.: PCT/CN2019/070925
§ 371 (c)(1),
(2) Date: May 15, 2019

(87) PCT Pub. No.: WO2019/157889
PCT Pub. Date: Aug. 22, 2019

(65) Prior Publication Data

US 2020/0271285 A1 Aug. 27, 2020

(30) Foreign Application Priority Data

Feb. 13, 2018 (CN) ..... 201810149044.9

(51) Int. Cl.
*F21S 2/00* (2016.01)
*F21V 19/00* (2006.01)
(Continued)

(52) U.S. Cl.
CPC ..... *F21S 2/005* (2013.01); *F21V 19/004* (2013.01); *F21V 19/0025* (2013.01);
(Continued)

(58) Field of Classification Search
CPC .... F21S 2/005; F21V 19/004; F21V 19/0045; F21V 21/005; F21V 19/0025; F21V 23/023; F21V 23/06; F21Y 2115/10
See application file for complete search history.

(56) References Cited

U.S. PATENT DOCUMENTS 9,395,052 B1 * 7/2016 Shew ..... F21K 9/27
10,393,323 B1 * 8/2019 Chartrand ..... F21K 9/27
(Continued)

FOREIGN PATENT DOCUMENTS

CN 202056668 U 11/2011
CN 202521333 U 11/2012
(Continued)

*Primary Examiner* — Donald L Raleigh
(74) *Attorney, Agent, or Firm* — Dragon Sun Law Firm, PC; Jinggao Li, Esq.

(57) ABSTRACT

An LED plant illumination lamp module includes at least two light source modules and two lamp module cases located at both ends of the light source modules. Each of the light source modules includes a lamp tube, a circuit board mounted inside the lamp tube, and LED lamp beads fixed on the circuit board. At least two lamp tube insertion slots are arranged on one side of each of the lamp module cases, and two ends of the lamp tube are respectively inserted into the lamp tube insertion slots on the lamp module cases. At least one of the lamp module cases is provided with an LED power supply, and an output end of the LED power supply is connected to the circuit board inside the lamp tube.

7 Claims, 11 Drawing Sheets

(51) Int. Cl.

| | |
|---|---|
| ***F21V 21/005*** | (2006.01) |
| ***F21V 23/02*** | (2006.01) |
| ***F21V 23/06*** | (2006.01) |
| *F21Y 115/10* | (2016.01) |

(52) U.S. Cl.
CPC ..... *F21V 19/0045* (2013.01); *F21V 21/005* (2013.01); *F21V 23/023* (2013.01); *F21V 23/06* (2013.01); *F21Y 2115/10* (2016.08)

(56) References Cited

U.S. PATENT DOCUMENTS

| | | | | |
|---|---|---|---|---|
| 10,823,347 | B2 * | 11/2020 | Snell | F21V 7/0008 |
| 2009/0296381 | A1 * | 12/2009 | Dubord | F21V 19/0045 362/218 |
| 2011/0038148 | A1 * | 2/2011 | Pyle | F21V 19/0085 362/235 |
| 2011/0080743 | A1 * | 4/2011 | Cheng | F21V 5/02 362/297 |
| 2013/0002164 | A1 | 1/2013 | Galluccio et al. | |
| 2014/0168961 | A1 * | 6/2014 | Dubord | F21V 21/14 362/225 |
| 2016/0201890 | A1 | 7/2016 | Sorensen et al. | |

FOREIGN PATENT DOCUMENTS

| | | | |
|---|---|---|---|
| CN | 204962640 | U | 1/2016 |
| CN | 206072861 | U | 4/2017 |
| CN | 206072908 | U | 4/2017 |
| CN | 206682646 | U | 11/2017 |
| CN | 108488656 | A | 9/2018 |

* cited by examiner

LED PLANT ILLUMINATION LAMP MODULE

CROSS REFERENCE TO THE RELATED APPLICATIONS

This application is the national phase entry of International Application No. PCT/CN2019/070925, filed on Jan. 9, 2019, which is based upon and claims priority to Chinese Patent Application No. 201810149044.9, filed on Feb. 13, 2018, the entire contents of which are incorporated herein by reference.

TECHNICAL FIELD

The present invention relates to the field of plant illumination technology, and particularly to an LED plant illumination lamp module with strong universality and wide application range.

BACKGROUND

LED lamps are widely used in plant industrial production due to their high luminous efficiency, luminescence, and easy to control. The application solution of the LED plant illumination lamps available now is integratedly designed according to the specific application occasions. The size, power, and other specifications of the lamps are fixed, which makes the lamps inapplicable to different occasions and not adjustable in circumstances where the actual on-site demand changes, and always requires a lot of external wiring.

SUMMARY

In view of the above-mentioned drawbacks of the prior art, the objective of the present invention is to provide an LED plant illumination lamp module with strong universality and wide application range.

To achieve the above and other related objectives, in one aspect, the present invention provides an LED plant illumination lamp module, including at least two light source modules and two lamp module cases located at both ends of the light source modules. Each of the light source modules includes a lamp tube and a circuit board mounted inside the lamp tube, and LED lamp beads are fixed on the circuit board. A plurality of lamp tube insertion slots are arranged on one side of each of the lamp module cases, and two ends of the lamp tube are respectively inserted into the lamp tube insertion slots on the lamp module cases. At least one of the lamp module cases are provided with an LED power supply, and an output end of the LED power supply is connected to the circuit board inside the lamp tube.

In one embodiment, two ends of each of the lamp module cases are provided with structural connecting components that match with each other.

In another embodiment, the structural connecting components are snap joints that match with each other.

In yet another embodiment, the two ends of the lamp module case which is provided with the LED power source are respectively provided with a female connector joint and a male connector joint. The LED power supply is electrically connected to the female connector joint and/or the male connector joint. In one embodiment, each of the lamp module cases is provided with a mounting portion, and the mounting portion is provided with a mounting hole or a sliding groove.

In yet another embodiment, the at least two light source modules are of the same specification, or at least one of the light source modules has different specifications than the other light source modules. According to the embodiments of the present invention, the lamp module and the assembly thereof have the advantages of strong universality, wide application range, convenient use, flexible installation, and rapid in adjustment.

DESCRIPTION OF THE REFERENCE DESIGNATORS OF THE COMPONENTS

Figure 1:
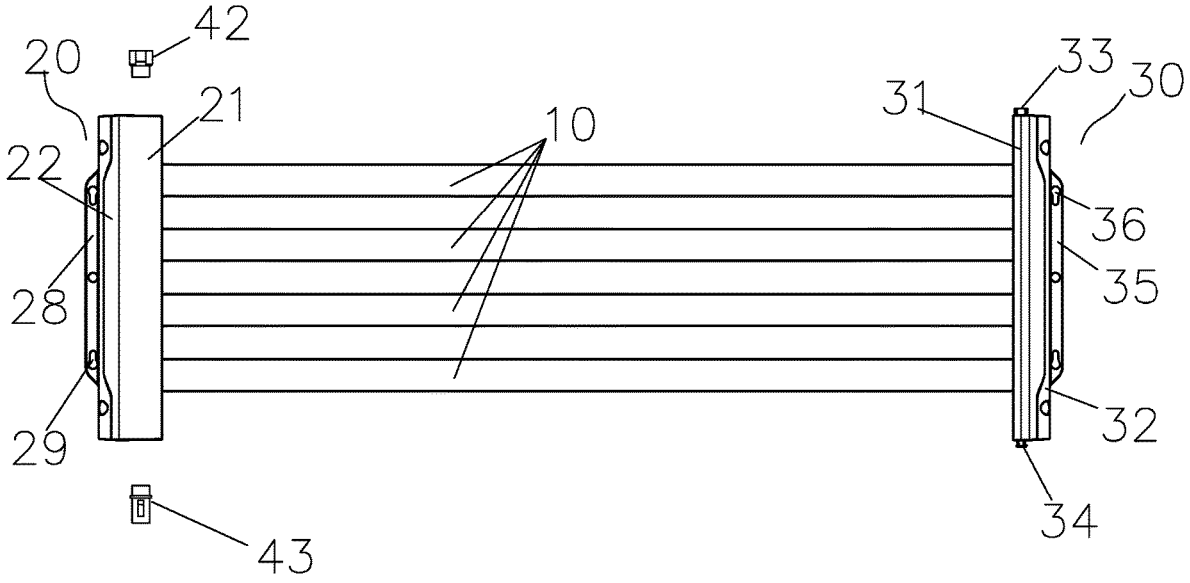
FIG. 1 is a top plan view of a lamp module according to one embodiment of the present invention.

10. light source module;
11. lamp tube;
12. circuit board;
13. LED lamp bead;
14. snap groove;
15. threaded hole;
16. connection terminal;
17. lamp tube end cover;
18. lamp tube open section;
20. first lamp module case;
21. first lamp module case body;
22. first lamp module case cover;
23. lamp tube insertion slot;
24. lamp tube wall snap groove;
25. snap joint;
26. screw;
27. screw;
28. mounting portion;
29. suspension holes;
30. second lamp module case;
31. second lamp module case body;
32. second lamp module case cover;
33. female snap joint;

34. male snap joint;
35. mounting portion;
36. suspension holes;
37. lamp tube insertion slot;
38. screw;
39. rib;
40. power supply;
41. connection terminal;
42. female connector joint;
43. male connector joint;
44. conduction wire;
45. circuit connection wire;
50. waterproof ring;
60. lamp holder;
61. mounting groove;
70. suspension rope.

DETAILED DESCRIPTION OF THE EMBODIMENTS

The implementations of the present invention are described hereinafter through specific embodiments. Those skilled in the art can readily learn other advantages and functions of the present invention from the disclosure of the specification.

It should be noted that the structure, proportion, size, etc. presented in the drawings of the specification are merely intended to match the contents disclosed in the specification for person familiar with this technology to understand and read, rather than to limit the implementation requirements of the present invention, and therefore have no technical significance. Any modifications of the structure, variations of the proportional relationship, or adjustments of the size not affecting the desired function and purpose of the present invention shall be considered as falling within the scope of the technical contents disclosed by the present invention. Meanwhile, the terms such as "upper", "lower", "left", "right", "middle", "one", etc. recited in the specification are merely intended to create clear description rather than limit implementable scope of the present invention. Variations or adjustments to the relative relationship, without substantial variation of the technical contents, should also be considered as falling within the implementable scope of the present invention.

Figure 2:
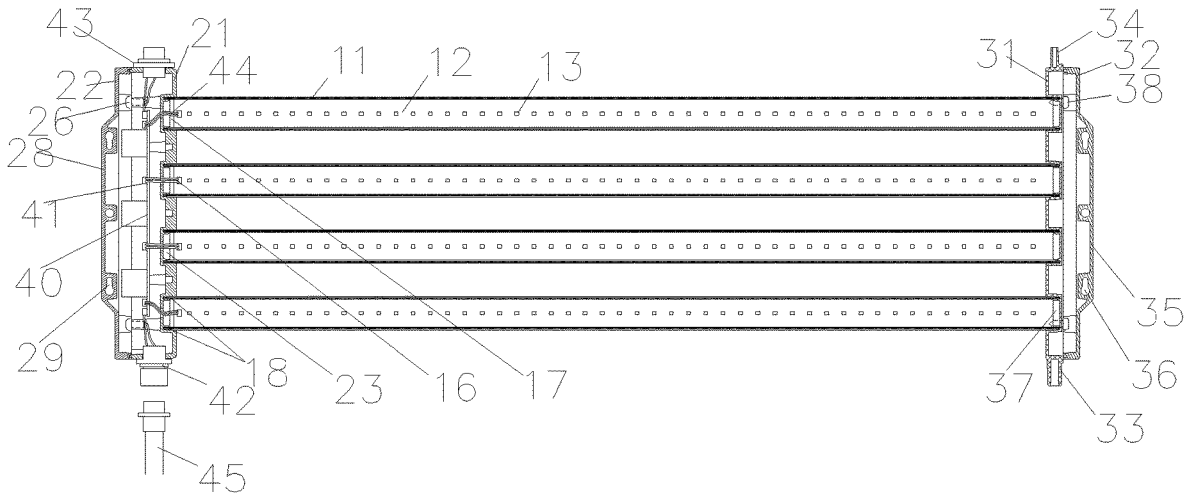
FIG. 2 is a bottom cross-sectional view of the lamp module shown in FIG. 1.

FIGS. 1 and 2 show an embodiment of the present invention. In this embodiment, the LED plant illumination lamp module includes light source module 10, first lamp module case 20, and second lamp module case 30. Two or more light source modules 10 are provided and are arranged in parallel. First lamp module case 20 and second lamp module case 30 are respectively located at two ends of light source module 10 for the assembly of light source module 10.

Light source module 10 includes lamp tube 11 and circuit board 12 mounted inside lamp tube 11. Circuit board 12 is mounted with LED lamp beads. One end of lamp tube 11, which is referred to as a connection end herein, is provided with connection terminal 16 for being electrically connected to a connection terminal on an output end of an LED power supply (see below description).

First lamp module case 20 can be composed of case body 21 and case cover 22. On one side of case body 21, a plurality of lamp tube insertion slots 23 are arranged along the length direction of case body 21. When the lamp module is assembled, light source module 20 is mechanically connected to first lamp module case 20 by inserting the connection end of lamp tube 11 into lamp tube insertion slot 23. Case cover 22 may be connected to case body 21 via screws 26 for the convenience of assembling and disassembling. On first lamp module case 20, specifically on a side of case cover 22 in this embodiment, mounting portion 28 may be further provided. Mounting portion 28 may be provided with one or more mounting holes or sliding grooves for facilitating the installation of the lamp module in different forms in the application, for example, the suspension holes 29 in this embodiment.

Figure 3:
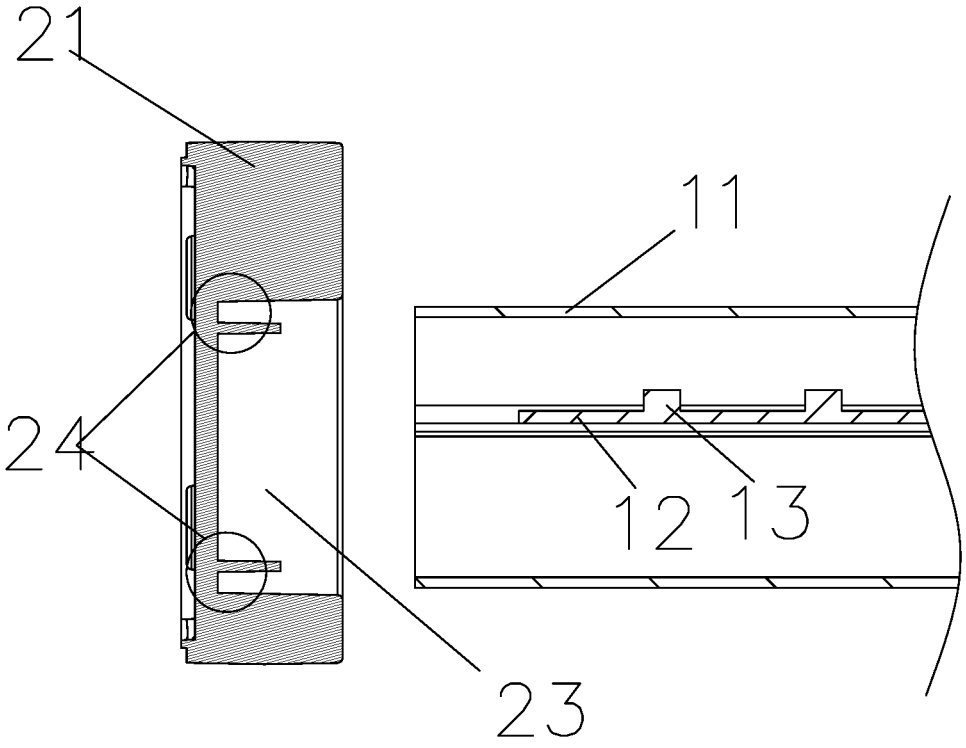
FIG. 3 is a schematic diagram showing a first example for fixing lamp tubes and lamp module cases according to the present invention.
Figure 4:
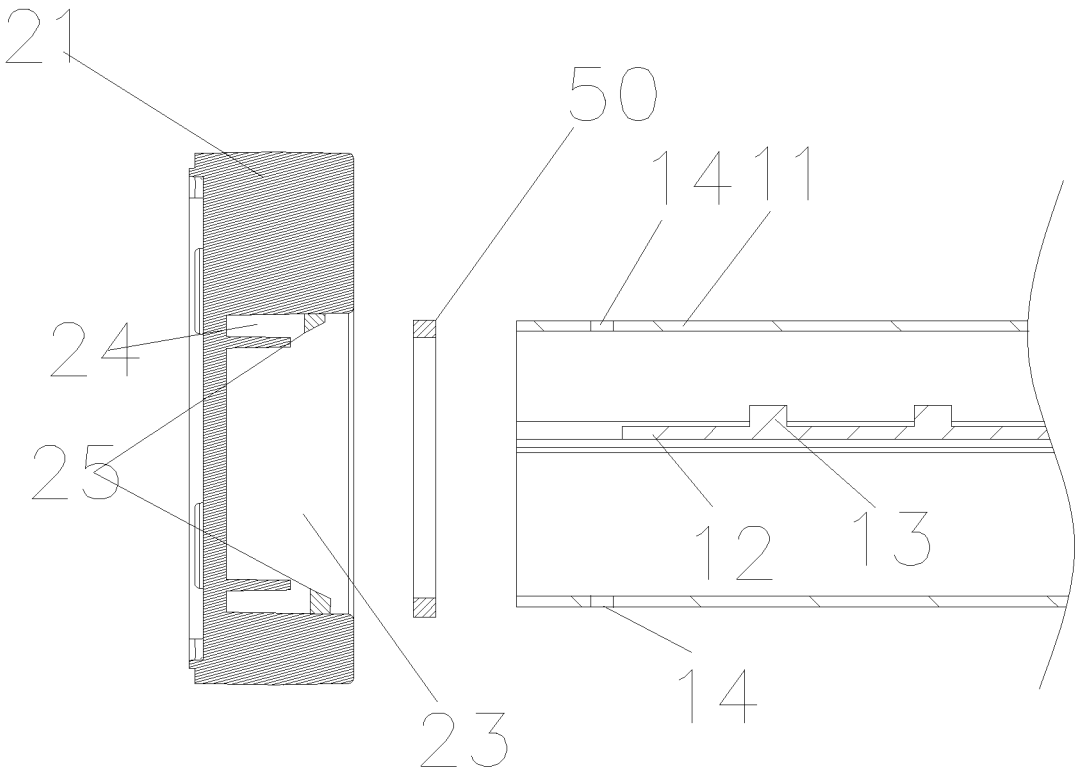
FIG. 4 is a schematic diagram showing a second example for fixing lamp tubes and lamp module cases according to the present invention.
Figure 5:
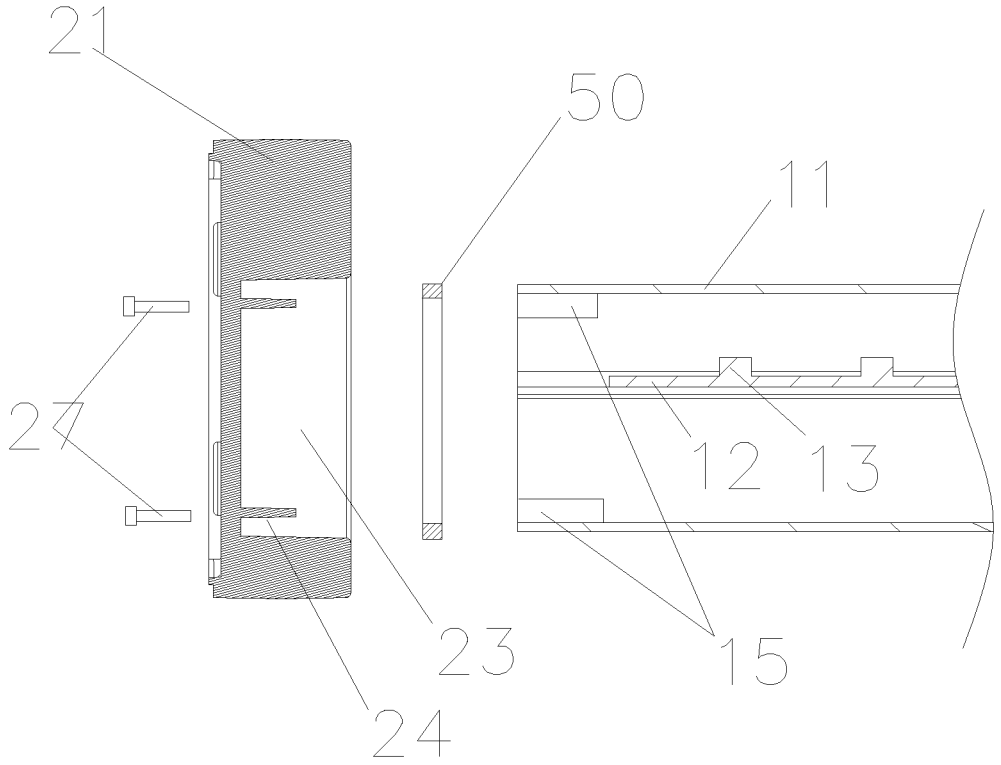
FIG. 5 is a schematic diagram showing a third example for fixing lamp tubes and lamp module cases according to the present invention.

In order to achieve a more stable connection between light source module 20 and first lamp module case 20, lamp tube 11 may be fixed on first lamp module case 20 by adhesive connection, snapping connection, or threaded connection. FIGS. 3-5 show the above-described three fixing modes, respectively. As shown in FIG. 3, the connection end of lamp tube 11 is inserted into lamp tube insertion slot 23 and is fixed with adhesive. As shown in FIG. 4, an inner wall of lamp tube insertion slot 23 is provided with snap joint 25, and correspondingly, the tube wall of lamp tube 11 is provided with snap groove 14. Lamp tube 11 inserted into lamp tube insertion slot 23 is fixed through the engagement of snap joint 25 and snap groove 14. In practical applications, the snap joint can also be configured on the lamp tube, while the snap groove may be configured inside the lamp tube insertion slot. As shown in FIG. 5, the end portion of lamp tube 11 is provided with threaded holes 15. After lamp tube 11 is inserted into lamp tube insertion slot 23, lamp tube 11 is fixed with first lamp module case 20 through the engagement of screws 27 and threaded holes 15.

Referring to FIGS. 4 and 5, in the cases of using snapping connection and threaded connection, waterproof ring 50 can be further provided between lamp tube 11 and lamp tube insertion slot 23. While, in the case of using adhesive connection, the waterproofing effect can be achieved by the adhesive.

Referring to FIGS. 2-5, lamp tube wall snap groove 24 may be further provided inside lamp tube insertion slot 23. Lamp tube wall snap groove 24 is formed by a protrusion part extending outward from the bottom of lamp tube insertion slot 23 and an inner wall of lamp tube insertion slot 23. The protrusion part may be continuously arranged in the circumferential direction of lamp tube insertion slot 23 or may be arranged at intervals. Correspondingly, the end of lamp tube 11 is provided with open section 18 extending beyond lamp tube end cove 17. When being assembled, the tube wall of open section 18 gets stuck in the lamp tube wall snap groove 24 to facilitate the positioning and installation of lamp tube 11 in lamp tube insertion slot 23.

As shown in FIG. 2, LED power supply 40 is also mounted inside first lamp module case 20. The output end of LED power supply 40 is provided with a plurality of connection terminals 41 (which correspond to lamp tube insertion slots 23) for an electrical connection with connection terminals 16 of lamp tube 11. It should be noted that the LED power supply is composed of a plurality of electronic components, and has a relatively complex structure. Therefore, for the sake of simplicity, FIG. 2 only schematically shows a common structural form of the LED power supply, namely, the circuit board and several electronic components connected on the circuit board. Those skilled in the art should be able to understand that the corresponding diagram does not necessarily represent the actual structure. Similarly, those skilled in the art should be able to understand that the connection relationship between connection terminals 41 and 16 in FIG. 2 is indicated with conduction wire 44. However, conduction wire 44 is merely used to indicate that there is an electrical connection relationship between connection terminals 41 and 16, rather than implying that this kind of connection mode must be adopted in practice. To facilitate the assembling, the two terminals are preferably connected by a plug-in structure. For example, the connection terminal of the LED power supply is arranged inside the lamp tube insertion slot, and the connection terminal of the light source module is inserted into the lamp tube insertion slot along with the lamp tube to realize the electrical connection with the connection terminal of the LED power supply. In addition, the LED power supply may be one power supply or composed of a plurality of power supplies, and each of the power supplies corresponds to one or more connection terminals.

As shown in FIGS. 1 and 2, two ends of first lamp module case 20, which refer to two ends of case body 21 in this embodiment, are respectively provided with a circuit connector in a fixed manner. One circuit connector is female connector joint 42 and the other circuit connector is male connector joint 43. Female connector joint 42 and male connector joint 43 are electrically connected to the LED power supply for external power input.

Figure 6:
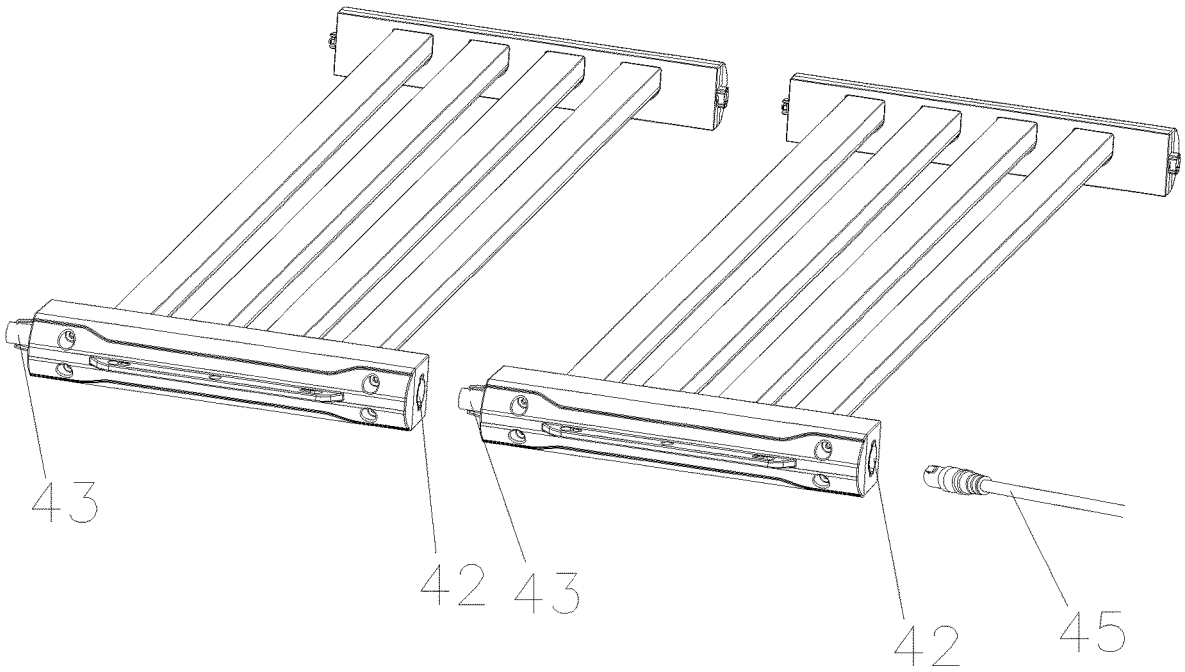
FIG. 6 is a schematic diagram showing a first example of the circuit connection mode of a lamp module according to the present invention.
Figure 7:
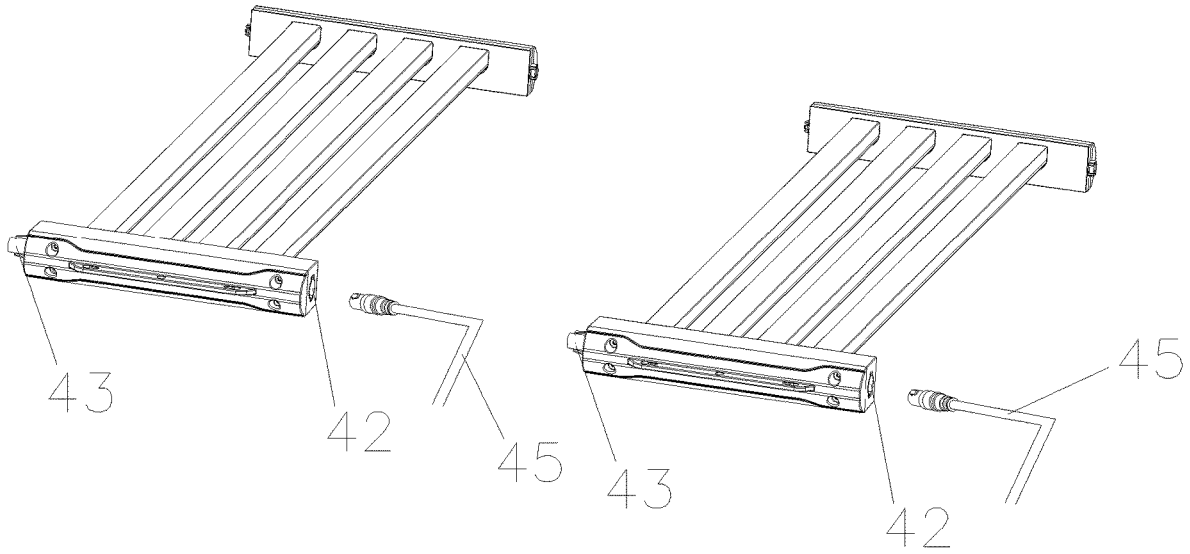
FIG. 7 is a schematic diagram showing a second example of the circuit connection mode of a lamp module according to the present invention.

FIGS. 6 and 7 show two power supplying examples of the first lamp module case in a practical application. As shown in FIG. 6, the power supply connection between the two first lamp module cases can be realized through the plug-in connection of male connector joint 43 and female connector joint 42, and then being connected to the external power source (which is not shown in the figures) via the circuit connecting wire 45. The connecting joint of circuit connecting wire 45 matches with female connector joint 42 or male connector joint 43. As shown in FIG. 7, in the case where the distance between the first lamp module cases is relatively far, each of the first lamp module cases can be respectively connected to the external power source through circuit connecting wires 45. Moreover, the connector is preferably a waterproof connector, and the circuit connecting wires are also preferably waterproof connecting wires.

Second lamp module case 30 can also be composed of case body 31 and case cover 32. On one side of case body 31, a plurality of lamp tube insertion slots 37 are arranged along the length direction of case body 31. When the lamp module is assembled, light source module 20 is mechanically connected to second lamp module case 30 by inserting the other end (namely, not the connection terminal) of lamp tube 11 into lamp tube insertion slot 37. Case cover 32 may be connected to case body 31 via screws 38 for the convenience of assembling and disassembling. On second lamp module case 30, specifically on a side of case cover 32 in this embodiment, mounting portion 35 may be further provided. Mounting portion 35 may be provided with one or more mounting holes or sliding grooves for facilitating the installation of the lamp module in different forms in the application, for example, the suspension holes 36 in this embodiment. Lamp tube insertion slot 37 and the ends of lamp tube 11 may also be further fixed by means of, for example, adhesive connection, snapping connection, and threaded connection etc., as previously described. A lamp tube wall snap groove may also be provided inside lamp tube insertion slot 37, and correspondingly, the other end of lamp tube 11 described above is provided with an open section.

Figure 8:
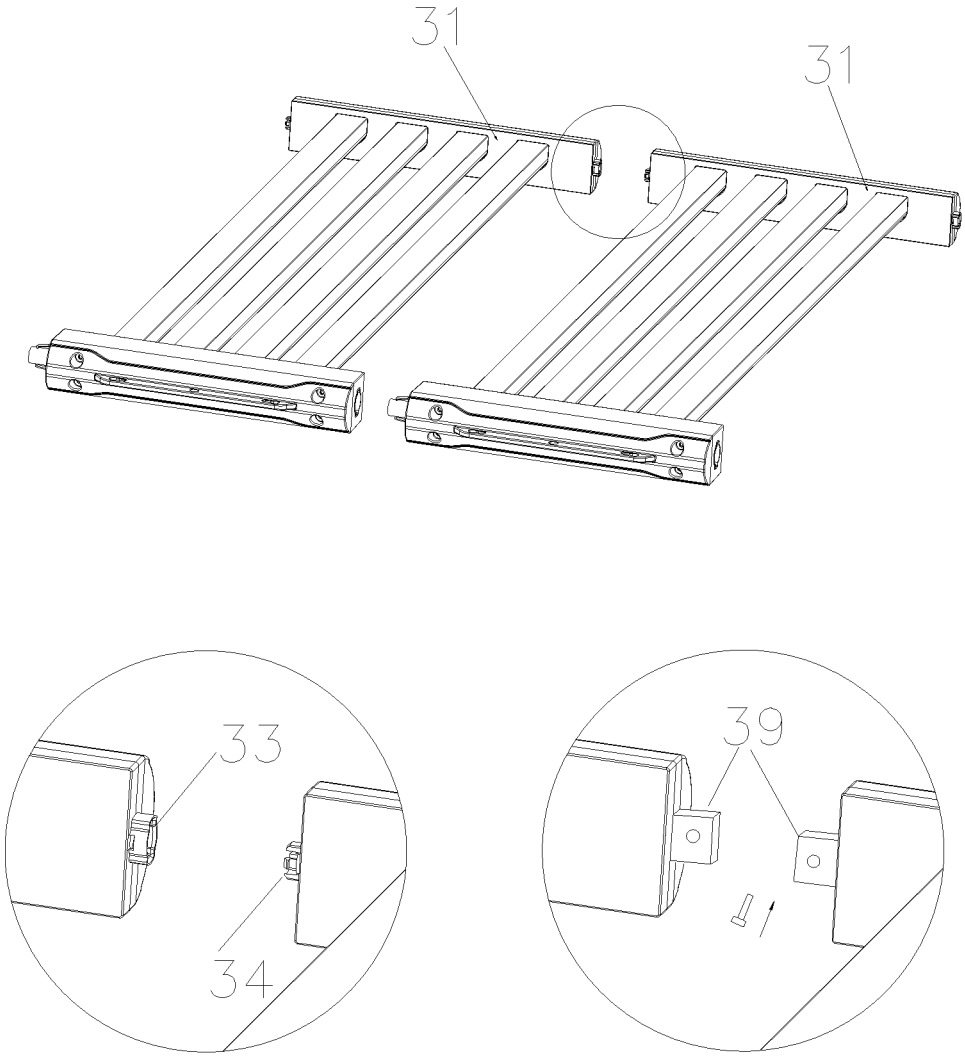
FIG. 8 is a schematic diagram showing an example for mechanically connecting two second lamp module cases according to the present invention.

As shown in FIGS. 2 and 8, on second lamp module case 30, specifically on both ends of case body 31, connecting components for realizing a mechanical connection between two lamp modules are provided. FIG. 8 shows two examples of the connecting components. In the first example, a snapping connection is used, one end of case body 31 is provided with female snap joint 33, and the other end of case body 31 is provided with female snap joint 34. In the second example, the snap joints are replaced with ribs 39 respectively configured at both ends of case body 31, and the adjacent ends of case bodies 31 of the different lamp modules are connected to each other by ribs 39. For example, the two ribs are fixed by screws, and correspondingly, the ribs are provided with threaded through holes. Although the second lamp module case for assembling the light source module is provided in the embodiment, the first lamp module case may also serve as the second lamp module case in practice. In this case, since the other end of the light source module has no connection terminal, the first lamp module case here merely serves for a mechanical connection.

Figure 9:
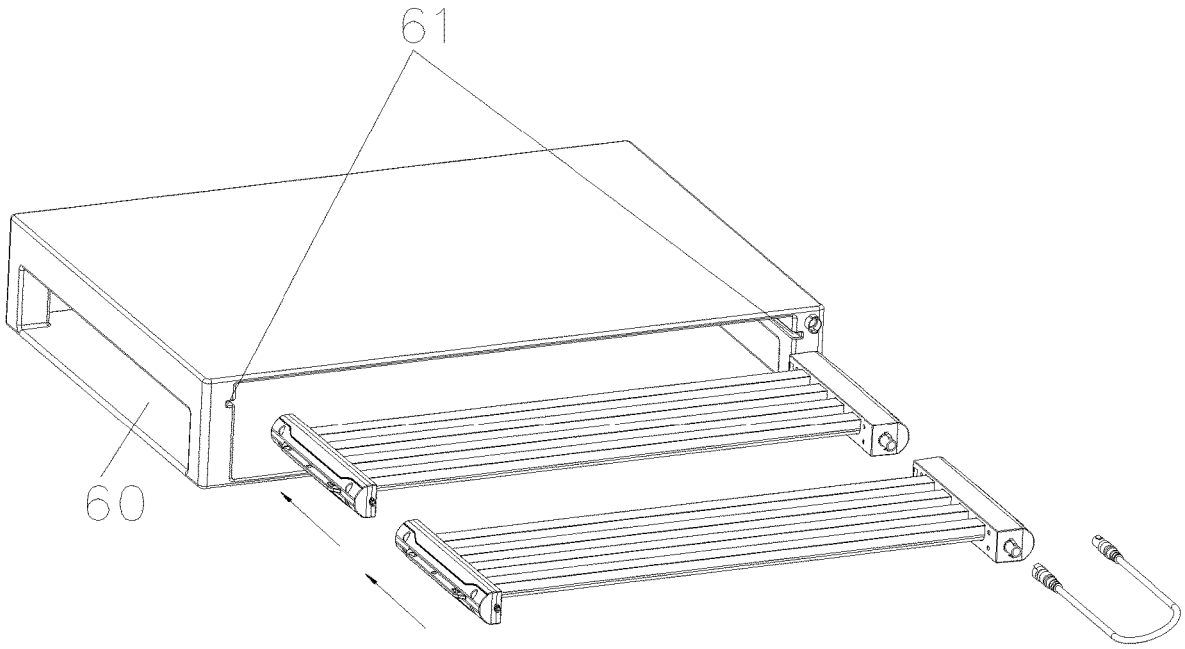
FIG. 9 is a schematic diagram showing an embedded mounting mode of a lamp module according to the present invention.
Figure 10:
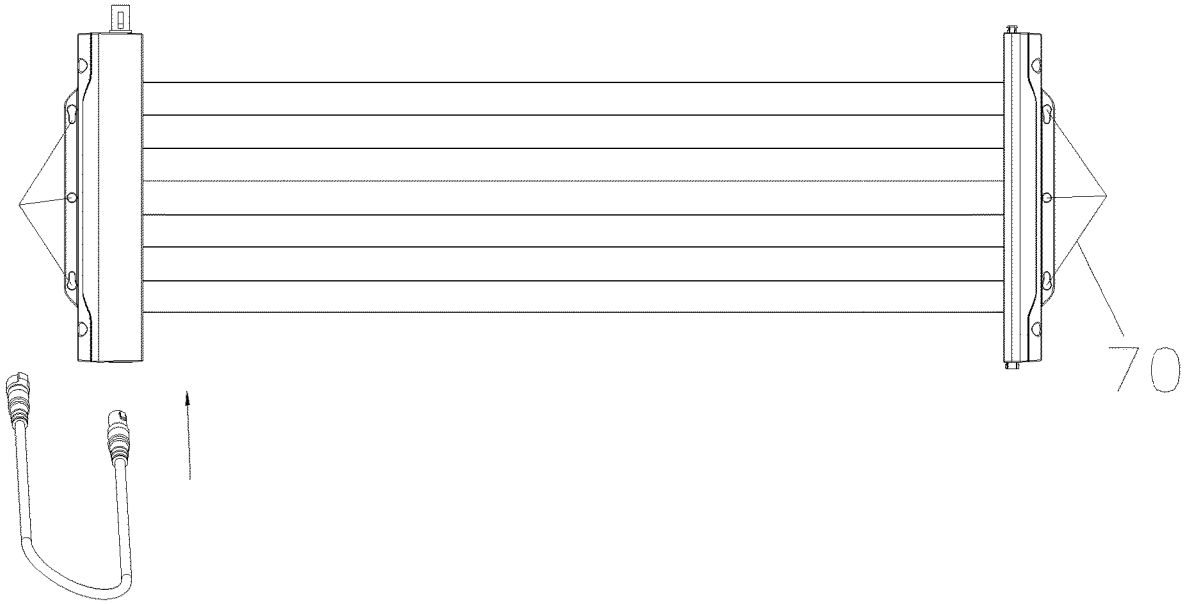
FIG. 10 is a top plan view showing a suspended mounting of a lamp module according to the present invention.
Figure 11:
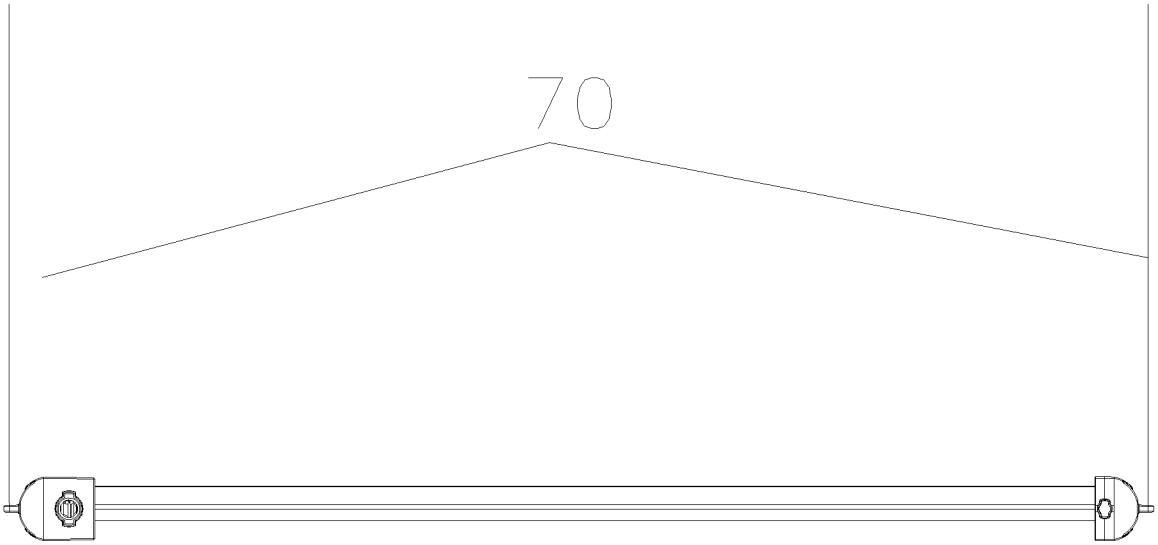
FIG. 11 is a front view of the lamp module shown in FIG. 10.

FIG. 9 and FIGS. 10 and 11 show two mounting examples of the lamp module in the application, respectively. FIG. 9 shows an embedded mounting mode, in which the lamp module is mounted on lamp holder 60 which is provided with mounting slot 61 suitable for the mounting portion on the lamp module case to be inserted therein. FIGS. 10 and 11 show a suspending mode, in which the suspension installation is achieved by suspension ropes 70 that pass through the suspension holes on the lamp module case.

The design of the lamp module proposed by the present invention greatly improves the universality and application range of the LED plant illumination lamp. In actual application, the selection or adjustment for the appropriate light source module and lamp module combination can be carried out according to the customer's needs and the differences of plants of different kinds and different growth stages. To this end, the light source module may be of different specifications, including but not limited to power, shape, size, light outgoing angle, etc. The light source modules of different specifications may be selected for different lamp modules, and the light source modules in the same lamp module may also be of different specifications. Preferably, the LED power supply has adjustable power, thereby further increasing the application range of the lamp module.

It can be seen that the above technical solution provided by the present invention has significant advantages. Not only the optimal combination of the light source module and the lamp module and the optimal arrangement of the spaces between the light modules can be performed according to different needs, but also the light source module and lamp module having different lighting angles, different powers, and different sizes can be quickly replaced. As a result, better illumination effects are achieved, the plant growth quality is improved, and resource waste is reduced. In addition, the power of the lamp is distributed in multiple light source modules, which can further reduce heat accumulation and prolong the service life of the lamp.

The above-described embodiments merely exemplify the principles and functions of the present invention and are not intended to limit the present invention. Modifications or variations of the above-described embodiments may be made by those skilled in the art without departing from the spirit and scope of the present invention. Therefore, all equivalent modifications or variations made by those of ordinary skill in the art without departing from the spirit and technical idea of the present invention should be considered as covered by the appended claims of the present invention.

What is claimed is:

1. An LED plant illumination lamp module, comprising:

at least two light source modules in parallel; and two lamp module cases in parallel and located at both ends of the at least two light source modules, wherein each of the two lamp modules cases is perpendicular to each of the at least two light source modules, wherein one end of the each of the at least wo light source modules is connected to one of the two lamp module cases; and the other end of the each of the at least two light source modules is connected to the other one of the two lamp module cases;

the each of the at least two light source modules comprises a lamp tube, a circuit board mounted inside the lamp tube, and LED lamp beads fixed on the circuit board;

at least two lamp tube insertion slots are arranged on one side of each of the lamp module cases, two ends of the lamp tube are respectively inserted into the lamp tube insertion slots on the lamp module cases;

at least one of the at least two lamp module cases is internally provided with an LED power supply, and an output end of the LED power supply is connected to the circuit board inside the lamp tube;

each end of the lamp tube comprises two thread holes perpendicular to the two lamp module cases; and two ends of the lamp tube are respectively inserted into the lamp tube insertion slots on the lamp module cases through the engagement of thread holes and screws.

2. The LED plant illumination lamp module according to claim 1, wherein the number of at least two light source modules is four.

3. The LED plant illumination lamp module according to claim 2, wherein each of two lamp module cases comprises a male connector and a female connector; and the LED plant illumination lamp module is connected to another LED plant illumination lamp module through female connectors and male connectors.

4. The LED plant illumination lamp module according to claim 1, wherein two ends of each of the at least two lamp module cases are provided with structural connecting components.

5. The LED plant illumination lamp module according to claim 4, wherein the structural connecting components are snap joints.

6. The LED plant illumination lamp module according to claim 1, wherein each of the at least two lamp module cases is provided with a mounting portion, and the mounting portion is provided with mounting holes or a sliding groove.

7. The LED plant illumination lamp module according to claim 1, wherein the at least two light source modules have a same specification, or at least one of the at least two light source modules has different specifications than other light source modules.

* * * * *